US007837074B2

(12) United States Patent
Rude et al.

(10) Patent No.: US 7,837,074 B2
(45) Date of Patent: Nov. 23, 2010

(54) GARMENT HANGER WITH A COLLAPSIBLE/RETRACTABLE SUPPORT HOOK

(76) Inventors: Richard R. Rude, 61 King Rd., Landing, NJ (US) 07850; Stanley Austin, 1901 Satter Ct., Yardley, PA (US) 19067

( * ) Notice: Subject to any disclaimer, the term of this patent is extended or adjusted under 35 U.S.C. 154(b) by 0 days.

(21) Appl. No.: 12/102,373

(22) Filed: Apr. 14, 2008

(65) Prior Publication Data

US 2008/0283558 A1 Nov. 20, 2008

Related U.S. Application Data

(60) Provisional application No. 60/923,700, filed on Apr. 17, 2007.

(51) Int. Cl.
*A41D 27/22* (2006.01)

(52) U.S. Cl. ..... 223/94; 223/85; 223/92; 223/DIG. 4

(58) Field of Classification Search ..... 223/85, 223/88, 89, 92, 94, 95, DIG. 4
See application file for complete search history.

(56) References Cited

U.S. PATENT DOCUMENTS 881,818 A * 3/1908 Morrison et al. ..... 223/94
1,893,815 A * 1/1933 Wilt, Jr. et al. ..... 223/88
2,701,082 A * 2/1955 Cohen ..... 223/85
3,289,985 A * 12/1966 Sheiman ..... 248/95
3,687,277 A * 8/1972 Spencer et al. ..... 206/284
3,726,452 A * 4/1973 Jaffe ..... 223/91
3,731,809 A * 5/1973 Saenger ..... 211/118
4,168,791 A * 9/1979 Clark, Jr. ..... 223/94
4,624,396 A * 11/1986 Universe ..... 223/92
4,717,053 A * 1/1988 Wang ..... 223/94
4,728,016 A * 3/1988 McPhee ..... 223/85
5,074,445 A * 12/1991 Chen ..... 223/85
5,085,357 A * 2/1992 Chen ..... 223/89
5,328,068 A * 7/1994 Shannon ..... 224/558
5,649,652 A * 7/1997 Sackett et al. ..... 223/85
6,000,587 A * 12/1999 Sackett et al. ..... 223/85

* cited by examiner

*Primary Examiner*—Gary L Welch
*Assistant Examiner*—Nathan E Durham
(74) *Attorney, Agent, or Firm*—Duane Morris LLP

(57) ABSTRACT

A garment hanger with a hook that pivots between a substantially vertical position and a substantially horizontal position. The body of the hanger having detents for securing the hook in either the vertical or horizontal position. The hook capable of being alternately attached and detached from the body of the hanger. The hook additionally capable of being rotated along a substantially vertical axis.

12 Claims, 21 Drawing Sheets

GARMENT HANGER WITH A COLLAPSIBLE/RETRACTABLE SUPPORT HOOK

CROSS-REFERENCE TO RELATED APPLICATIONS

The present application claims the benefit of U.S. Provisional Application Ser. No. 60/923,700, filed on Apr. 7, 2007, the entirety of which is hereby incorporated by reference.

FIELD OF INVENTION

The invention relates to garment hangers and, in particular, a garment hanger with a collapsible or retractable and/or removable support hook that enables clothing and other items to be easily transported and stored.

BACKGROUND OF THE INVENTION

Conventional clothes hangers typically comprise an integrally formed rigid structure having central portion, a support hook to affix to a rod, a pair of upper members extending in opposite directions from the central portion and, in some cases, a lower transverse member extending between the pair of upper members. Normally, when a lower traverse member extends between the pair of upper members, the upper members extend from the central portion at a slightly downward angle.

Several types of garment hangers are commonly used for hanging clothes. Common hangers include wire hangers, plastic hangers, wood hangers and padded cloth hangers. Hangers are also varied in size. Each of these types and sizes of hangers have both advantages and disadvantages.

Typically, the shoulders of a garment, such as a shirt, coat or jacket, are draped over the upper members of the hanger to suspend the garment from the hanger, which in turn is affixed and suspended from the hanger rod. The garment is generally in an upright orientation so as to reduce the risk of wrinkling or creasing.

A variety of foldable clothes hangers have been proposed in the past which are foldable into a relatively compact unit for storage and transportation, and which may be deployed to form a conventional hanger when needed. Such clothes hangers are typically entirely collapsible and are not intended to support garments or clothes during storage and transportation. As such, they do not provide utility in transporting clothes or garments. For example, when utilizing such collapsible hangers in transit, a user typically removes the desired garments from the hangers, packs the garments in a suitcase, bag or other container, and then folds or collapses the hangers. Thereafter, upon arrival at the desired destination, the user unpacks the hangers, assembles the hangers and suspends the hangers. Then the user individually drapes each garment unpacked from the suitcase, bag or container to its corresponding hanger. This method of transporting clothes and other items from a manufacturer is extremely time consuming and impractical in many instances where the immediate sorting and distribution of packed garments is necessary.

SUMMARY OF THE INVENTION

It is an object of the present invention to provide an improved garment hanger having a collapsible or retractable support hook.

Another object of the present invention is to provide an improved garment hanger having a support hook capable of collapsing from a first, upright position to a second, collapsed position, the collapsed position in closer proximity to the body of the hanger compared to the upright position.

A further object of the present invention is to provide a hanger that reduces the shipping cost of clothing that remains on the hanger during shipping by reducing corrugation and space in containers.

A still further object of the present invention is to provide a hanger having an alternately removable and attachable hook.

These and other objects are met by the present invention, which in one aspect is a garment hanger comprising a central support member; a support hook operably connected to the central support member, the support hook adapted to move between a generally horizontal position and a generally upright position; and a first arm member and a second arm member, each arm member connected to and extending away from the central support member. The support hook can move about a pivot point between a generally horizontal position and a generally upright position along the longitudinal axis of the central support member. The hanger can optionally include at least one strap retaining device or a portion of an arm member shaped to retain clothes (e.g., the strap of a dress). In one embodiment, the hanger further comprising a lower member connected to and extending between the first arm member and second arm member, and wherein the first arm member and second arm member extends downwardly away from the central support member. In another embodiment, the central support member includes a restraining device capable of locking the central support member in the substantially upright position. The restraining device can comprise a body having a first end, a second end and a channel, the channel positioned longitudinally through the body from the first end to the second end, wherein the channel comprises an upper portion and a base portion, the base portion sized to receive a base of the support hook.

In another aspect, the present invention is a garment hanger comprising: a central support member; a support hook pivotally connected to the central support member, the support hook adapted to move between a collapsed position and the generally upright position; and a first arm member and a second arm member, each arm member connected to and extending away from the central support member.

In yet another aspect, the present invention is a garment hanger comprising: a central support member; a support hook pivotally connected to the central support member, the support hook adapted to move about a pivot point between a collapsed position and the generally upright position; a restraining device secured to the central support member, and operably connected to the support hook, the restraining device comprising a body having a channel that is positioned longitudinally through the body, the channel comprising a upper portion and a base portion, the base portion sized to receive a base of the support hook, whereby the support hook can be removably secured to an upright position when the base of the support hook is removably engaged with the base portion of the channel; and a first arm member and a second arm member, each arm member connected to and extending away from the central support member. In one embodiment, the hanger can comprise a lower member connected to and extending between the first arm member and second arm member, and wherein the first arm member and second arm member extends downwardly away from the central support member.

DETAILED DESCRIPTION OF THE DRAWINGS

Figure 1:
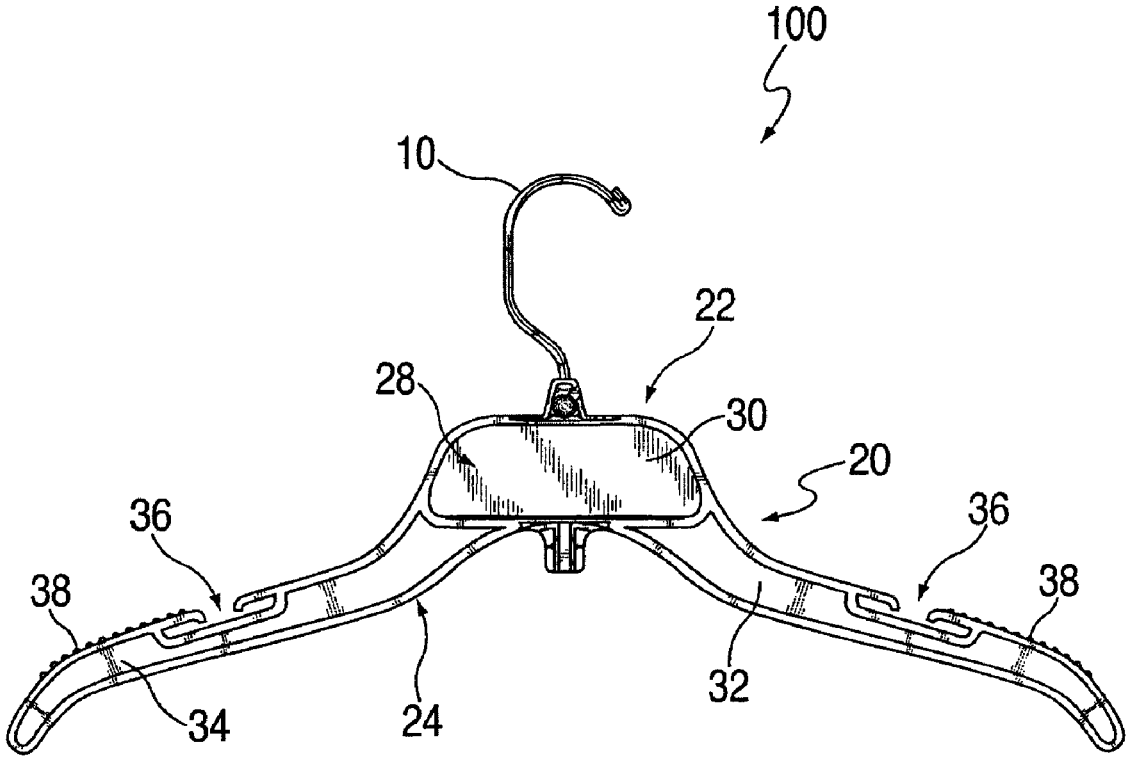
FIG. 1 is a front view of the hanger with the support hook in a first position according to one embodiment of the present invention.

Referring to FIG. 1, a hanger 100 is shown according to a first embodiment of the present invention. The hanger 100 generally comprises a hook 10 and a body 20. Clothing is suspended on the body 20. The hook 10 is designed to rest upon a rod and support the clothing in an upright manner. Although the hanger 100 is described as a garment hanger, it is to be understood that the present invention can be utilized by garment hangers, apparel hangers or other soft good hangers applicable in a variety of industries.

As will be discussed in further detail below, the hanger 100 is designed so that the support hook 10 is collapsible and/or removable. Thus, the height of the hanger 100 is reduced and the space required by the hanger 100 is minimized for transport. The hanger 100 allows clothing and other items to be easily transported and stored. More specifically, clothes can be draped on the hanger 100, the hook 10 can collapse and/or be removed from the body 20, and then the clothing can be transported without removing, it from the body 20 of the hanger 100. Upon arrival at the desired destination, the hook 10 can be reattached and/or extended so as to be suspendable from a rod while the clothing remains on the hanger 100.

Transporting clothing on a hanger is desirable for a variety of reasons. For example, during high volume delivery of garments or apparel, it is inefficient (e.g., in extra time and cost) to have the contents of a container sorted and hung on garment racks at the distribution hub. This can eventually lead to a build-up and backlog, as such items cannot be redistributed faster than they are received at the distribution hub. In addition, as the retail destination of many garments and apparel display such items on hangers, it is desirable that the garment-on-hanger configuration remains intact during shipment to facilitate handling of such items. As another example, a user may find it more convenient to pack garments and the like along with their hangers, as not having to remove and then attach each garment to its hanger saves valuable time and effort.

Garments and apparel when packed attached to conventional hangers, however, often increase the length of the shipping container, sometimes substantially depending on the garment or article of clothing desired to be shipped. The support hook 10, extends upwards several inches from the base of the hanger, as shown in FIG. 1. Items shipped using conventional carriers such as the United States Postal Service, UPS® or FedEx® are typically priced based on dimensions rather than weight. For example, an item desired to be shipped that is placed in a 3' by 4'×1.5" cardboard container may cost substantially more if placed in a slight larger 4 by 4' by 1.5" cardboard container, even though the content weight of the respective containers are identical. The hanger 100 allows for the maximum utilization of space when transporting clothes, garments or apparel that remain on the hanger 100 because the support hook 10 collapses and reduces the overall height of the hanger 100.

Figure 2:
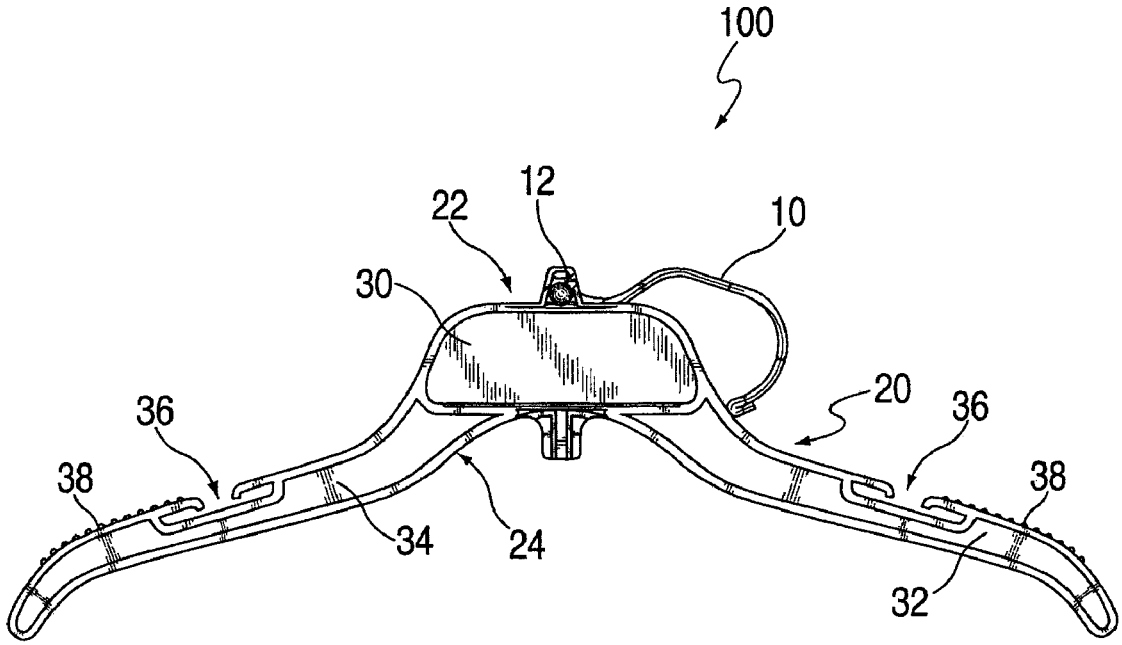
FIG. 2 is a front view of the hanger of FIG. 1 with the support hook in a second position, according to one embodiment of the present invention.
Figure 3:
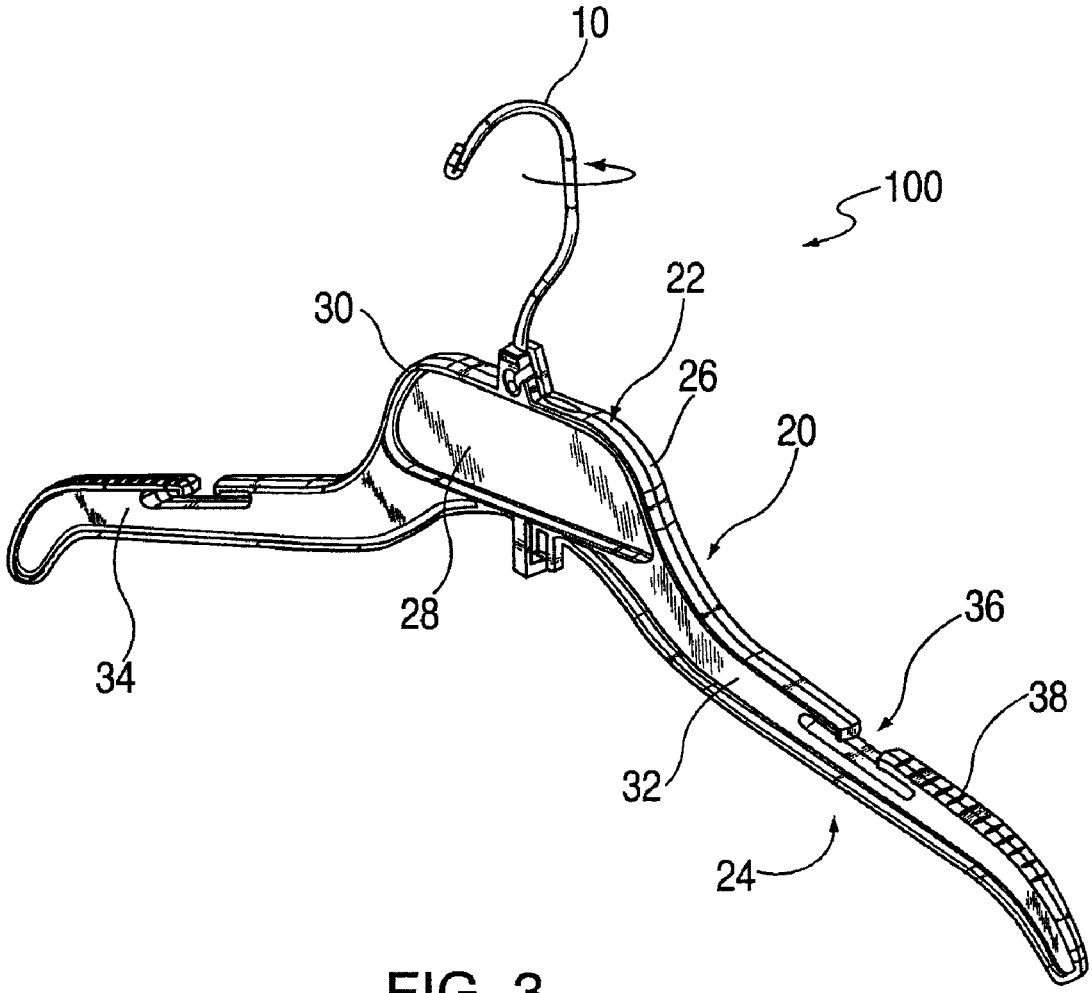
FIG. 3 is a perspective view of the hanger of FIG. 1 with the support hook rotated along the vertical axis by 90 degrees, according to one embodiment of the present invention.

Referring to FIGS. 1-3 concurrently, the body 20 of the hanger 100 comprises a top surface 22, a bottom surface 24, a rear surface 26 and a front surface 28. The body 20 is made of any material suitable for supporting garments, apparel or other items. Such materials include but are not limited to plastic, metal, aluminum, wood, plastic composites, metal composites, rubber or any combination thereof. In one preferred embodiment of the present invention, the body 20 of the hanger 100 is made of a rigid plastic. The body 20 further comprises a central portion 30 at the center point of the body and from which the hook 10 extends in a generally vertical direction. Extending from the central portion 30 are a first arm member 32 and a second arm member 34. The first and second arm members 32, 34 are identical to each other and extend in opposite directions from each other at a slightly downward angle from the horizontal plane of the central portion 30. It is preferred that the central portion 30, first arm member 32, and second arm member 34 are integrally formed to provide the required rigidity and support for garments and the like attached to the hanger 100. However, it is understood that the body 20 of the hanger 100 can be constructed in a variety of way including but not limited to fastening, welding, and screwing of pieces together to form the hanger 100 of the present invention.

The hanger 100 further comprises at least one garment retaining device 36 on each arm member 32, 34. The garment retaining devices 36 comprise apertures within the top surface of the body 20 at or near a center of each arm member 32, 34. The apertures have a lipped opening, where the edge of the lipped opening has a tapered edge. This prevents portions of the garment connected by the garment retaining devices from slipping or detaching off the hanger. Although the garment restraining devices 36 are shown as an indentation in the top surface of the body 20, the invention is not so limited. For example, the garment retaining devices could include but are not limited to clips, rubber strips, or a tacky covering that removably secures a portion of a garment (for example, the strap of a dress) to the hanger 100

The distal ends of the arm members 32, 34 further comprise a plurality of protrusions 38 forming a ridge-like surface. The protrusions 38 provide additional friction to the arm members 32, 34 so that a garment positioned on the hanger 100 will not easily slide off of the hanger 100. The protrusions 38 could be integrally formed with the arm member 32, 34. Alternatively, the protrusions 38 could be a strip of rubber material having the ridged feature that is glued or otherwise affixed to the top surface of the body 20 at or near the distal ends of the arm members 32, 34.

In another embodiment, the hanger 100 has a lower member (not shown) connected to and extending between the first arm member 32 and second arm member 34. The first arm member 32 and second arm member 34 preferably extends downwardly away from the central portion 30.

The hook 10 extends from the center portion 30 of the body 20 in a substantially vertical orientation. In this first position, the hook 10 is capable of being temporarily secured to a hanger rod, closet rod, or other item, as well as suspending the body of the hanger 100 along with any garment or apparel attached thereto. The hook 10 pivots along a pivot axis from the substantially upright position (as seen in FIG. 1) to intermediary positions (as seen in FIG. 8B) and finally to a substantially collapsed position (as seen in FIG. 2). This can be accomplished through a variety of ways. In the illustrated embodiment, the hook 10 comprises a hall 12 that is inserted into a socket 44 via an opening 42 (shown in FIG. 5) in the body 20. The ball 12 allows for the rotation and pivoting of the hook 10 relative to both the vertical and horizontal axes of the body 20.

Figure 4:
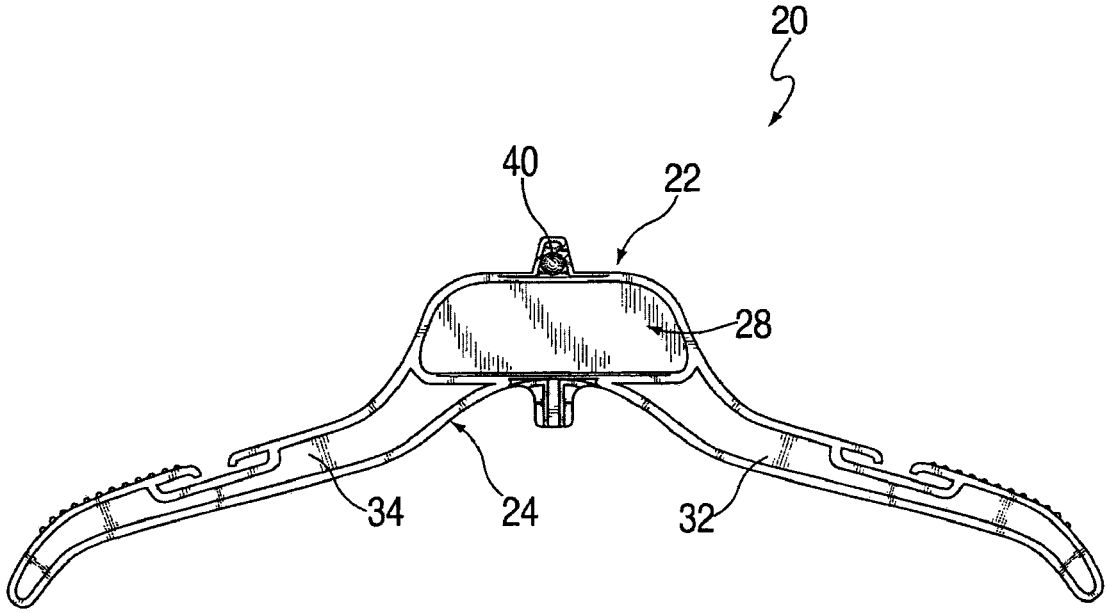
FIG. 4 is a front view of the body of the hanger of FIG. 1, according to one embodiment of the present invention
Figure 5:
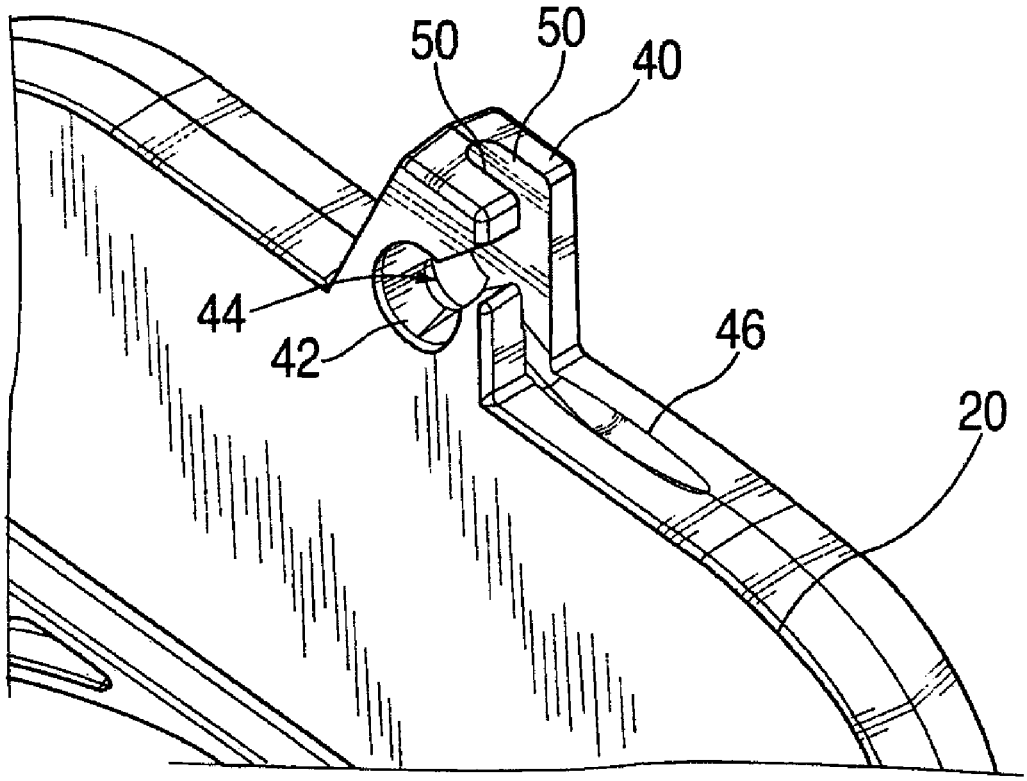
FIG. 5 is a close up perspective view of the opening and socket for receiving the support hook of the hanger of FIG. 1, according to one embodiment of the present invention.

Referring to FIGS. 4 and 5, concurrently, the body 20 comprises a protrusion 40 extending upward from the top surface 22 at a center of the body 20. The protrusion 40 comprises the opening 42 into the socket for receiving the ball 12 attached to the bottom end of the hook 10.

Figure 6A:
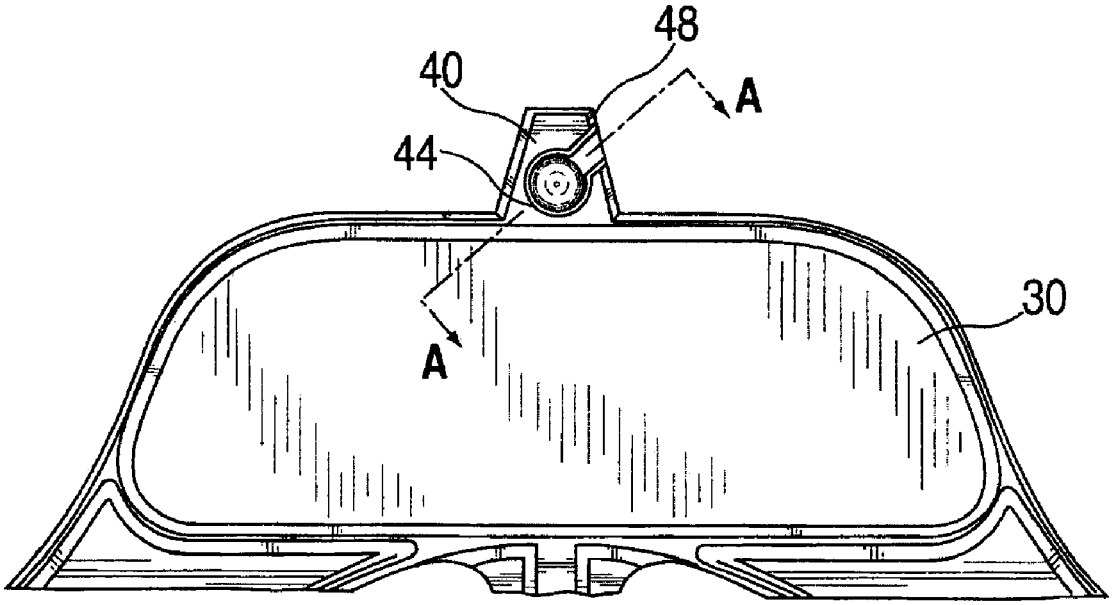
FIG. 6A is a close up front view of the opening and socket of FIG. 5, according to one embodiment of the present invention.
Figure 6B:
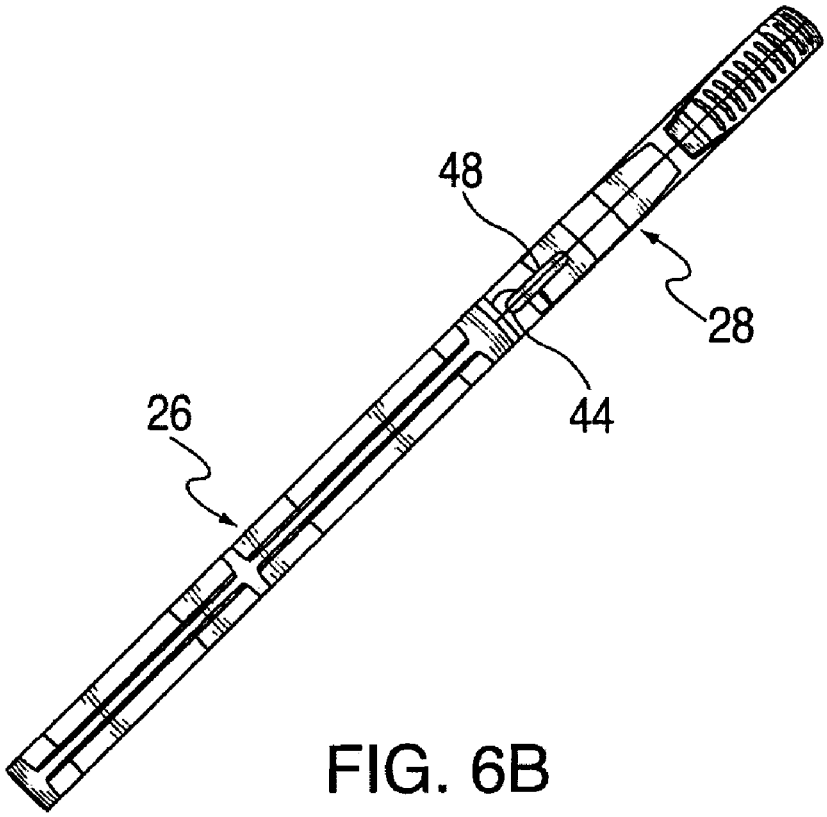
FIG. 6B is a view along the cross-section A-A of FIG. 6A, according to one embodiment of the present invention.

Referring now to FIGS. 5, 6A and 6B concurrently, the socket 44 is a circular shaped hole that is shaped and sized to hold the ball 12. The socket 44 has a circumference that is slightly larger than the circumference of the ball 12 of the hook 10. The ball 12 is inserted into the socket 44 and can be rotated about both the vertical and horizontal axes. Although illustrated as circular in shape, the socket 44 can be of any shape including but not limited to a rectangular, spherical, cylindrical, square, any combination thereof and the like. It is preferred however, that the ball 12 of the support hook 10 and the socket 44 of the body 20 both be cylindrical shape.

The socket 44 extends from the opening 42 in the front surface of the body 20 and into the body 20. In this embodiment, the socket 44 does not extend through the rear surface 26 of the body 20 but rather extends about ¾ into the body 20. The configuration of the protrusion 40 and the hook 10 allows for the hook 10 to pivot along the longitudinal line of body 20 of the hanger 100 (i.e, lengthwise through the central portion 30, first arm member 32 and second arm member 34). It is understood, however, that the ball 12 can be secured to the central support member 30 and connected to the base of the support hook 10 in such a manner such that the support hook 10 does not strictly pivot along the longitudinal line of the body 20. For example, the support hook 10 could be capable of pivoting in a variety of axes, including perpendicular to the longitudinal line of the body 20 or at different angles relative to the longitudinal line of the body 20.

The protrusion 40 further comprises a channel 48 for receiving the straight portion 14 of the hook 10. The width of the channel 48 is slightly larger than the width of the straight portion 14 of the hook 10 so that the straight portion 14 can fit through the channel 48. Within the channel 48 are a pair of detents 50 on opposite sides of the inner surface of the channel 48. The detents 5Q reduce the width of the channel 48 so that the straight portion 14 can be secured within the channel 48 in the upright position shown in FIG. 1. The straight portion 14 of the hook 10 is pushed past the detents 50 by applying a small amount of force. Thus, the hook 10 does not collapse (or extend into the upright position) unless the straight portion 14 of the hook 10 is pushed past the detents 50. This design allows for the base of the support hook 10 to be pushed or forced past the detents 50 and into the inner portion of the channel (and vice versa). Without the use of force, however, the base of the hook 10 cannot move through the channel 48. Thus, the base of the hook 10 can be forced or pushed through the outer portion of the channel 48 and into the inner portion of the channel 48, whereby it is removably secured or locked in a position parallel to the length of the body 20.

Figure 7A:
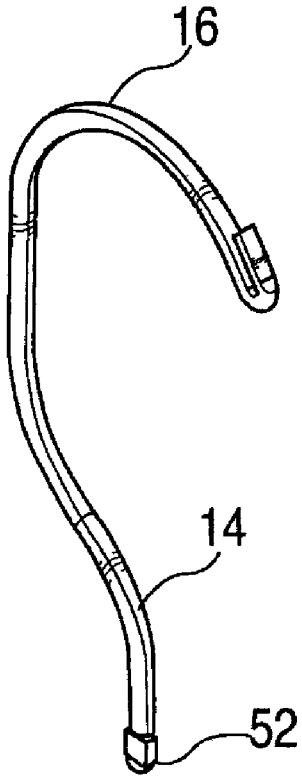
FIG. 7A is a front perspective view of the support hook, according to one embodiment of the present invention.
Figure 7B:
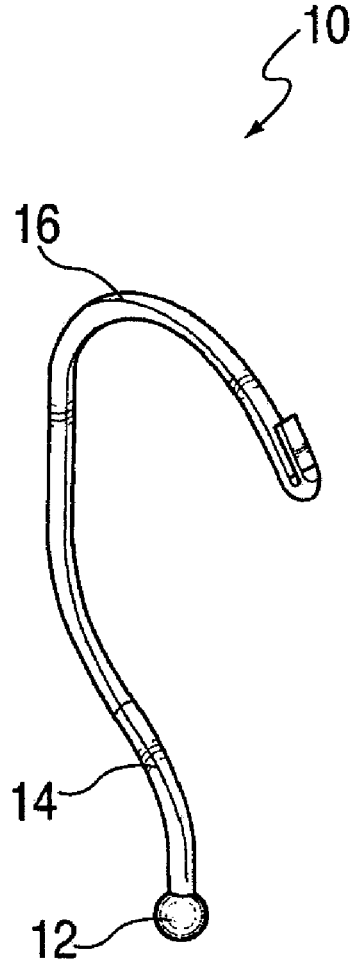
FIG. 7B is a front perspective view of the support hook of FIG. 1, according to one embodiment of the present invention.

Referring now to FIGS. 7A and 7B concurrently, the hook 10 is illustrated according to a first embodiment of the present invention, removed form the hanger 100 so that its features are more clearly visible. The hook 10 comprises a first end 14 and a second end 16. The first end 14 is a substantially straight, or linear, rod like structure. The second end 16 is a curved or hooked structure. The first end 14 of the support hook 10 extends from the hanger 100 in a substantially upright position (as shown in FIG. 1). The ball 12 is connected to the first end 14 of the support hook 10. FIG. 7A shows the hook 10 without the ball 12. At the first end 14 is a rectangular shaped ridge 52 that provides the connection for the ball 12. The ball 12 is formed around the ridge 52. The ball 12 is preferably made of a hard plastic material that can be easily formed. The hook 10 is preferably made of metal. The invention is not limited to any particular material however, unless specifically claimed.

Figure 8A:
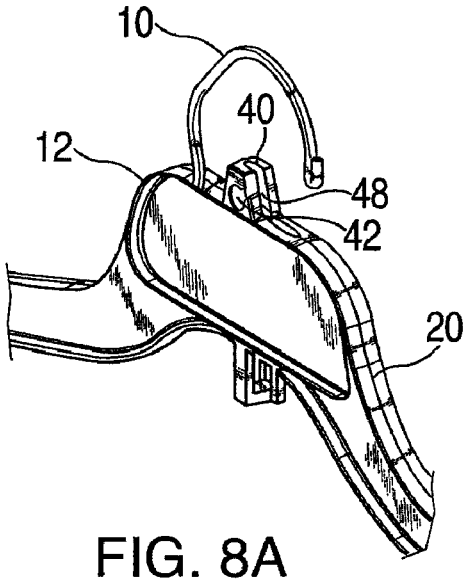
FIG. 8A is a front perspective view of the support hook positioned adjacent the opening of FIG. 5, according to one embodiment of the present invention.
Figure 8B:
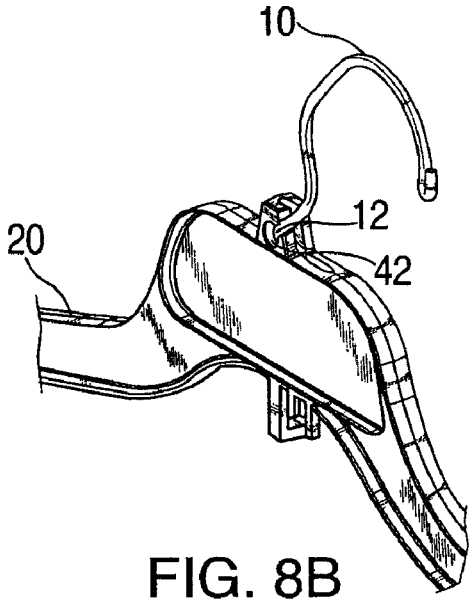
FIG. 8B is a front perspective view of the support hook attached to the body of the hanger of FIG. 8A, the support hook illustrated positioned in both a collapsed position and an upright position, according to one embodiment of the present invention.
Figure 8C:
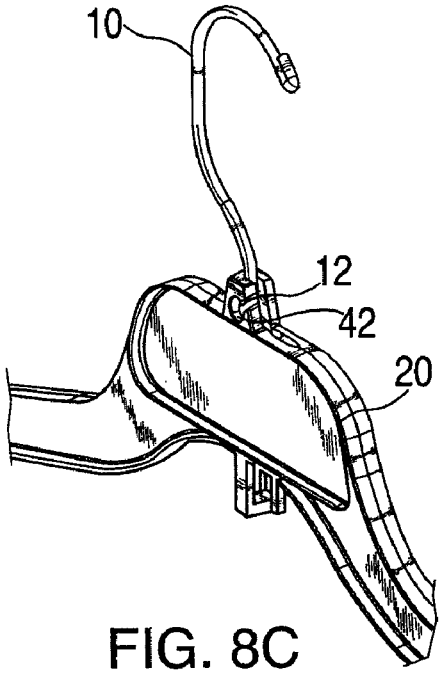
FIG. 8C is a front perspective view of the support hook in a first position in the body of the hanger of FIG. 8B.

Referring now to FIGS. 8A, 8B and 8C, a method for inserting the hook 10 into the body 20 is illustrated according to a first embodiment of the present invention. The hook 10 is positioned adjacent the body 20, as shown in FIG. 8A. The ball 12 is aligned with the opening 42. The straight portion 14 of the hook 10: is aligned with the channel in the front of the protrusion 40 so that the hall 12 can be inserted into the socket 44. The straight portion 14 is inserted into the channel 48 in the side of the protrusion 4Q, as shown in FIG. 8B. The straight portion 14 of the hook 10 is then pushed past the detents 50 (shown in FIG. 5) so that the hook 10 is secured in the raised position, as shown in FIG. 8C.

Figure 9:
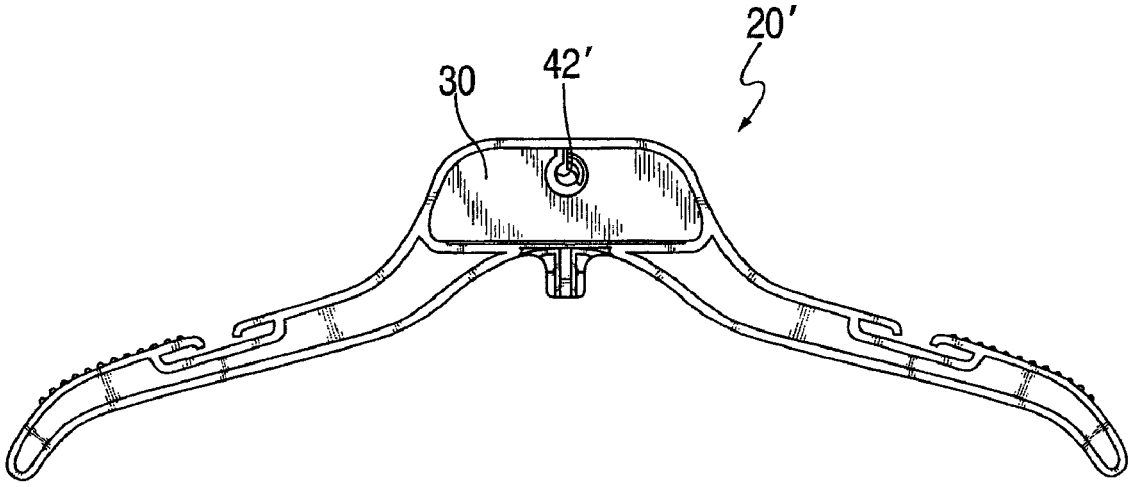
FIG. 9 is a front view of the body of a hanger according to a second embodiment of the present invention.
Figure 10:
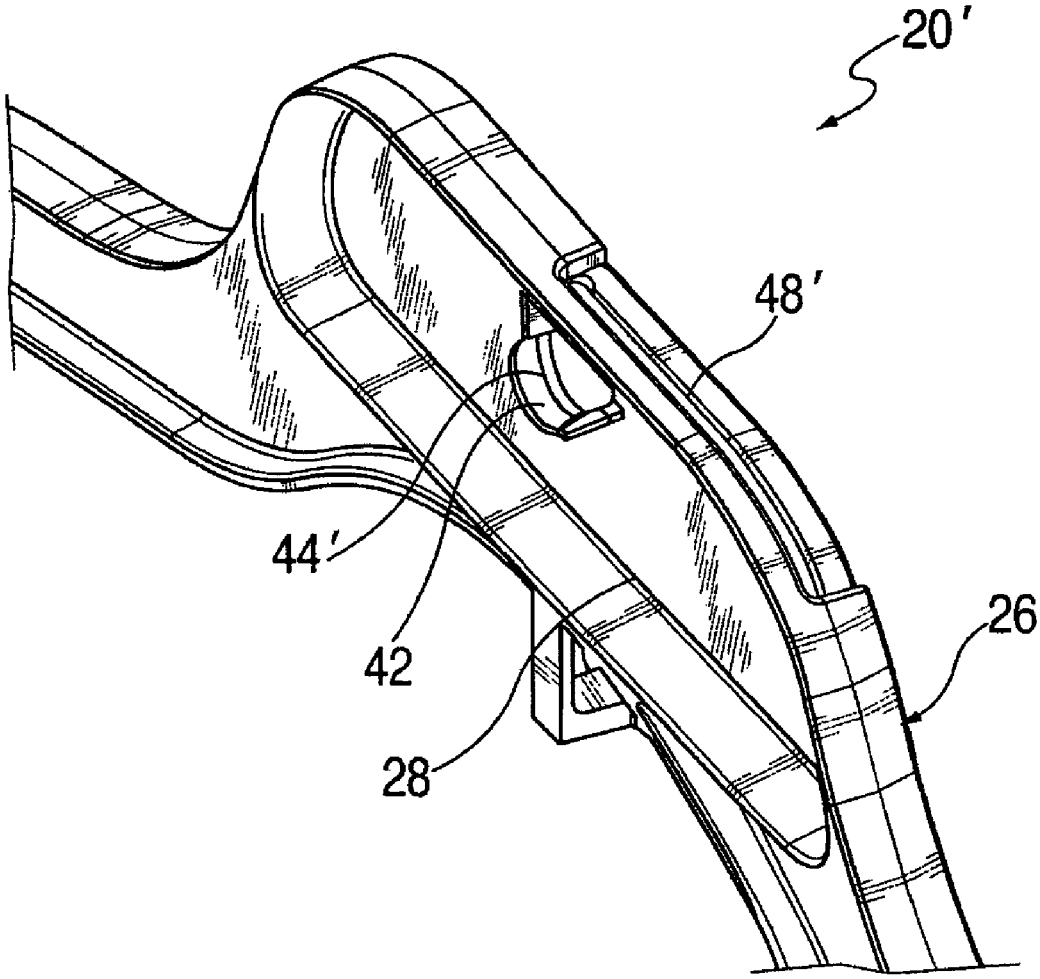
FIG. 10 is a close up front perspective view of the central portion of the hanger body of FIG. 9.
Figure 11A:
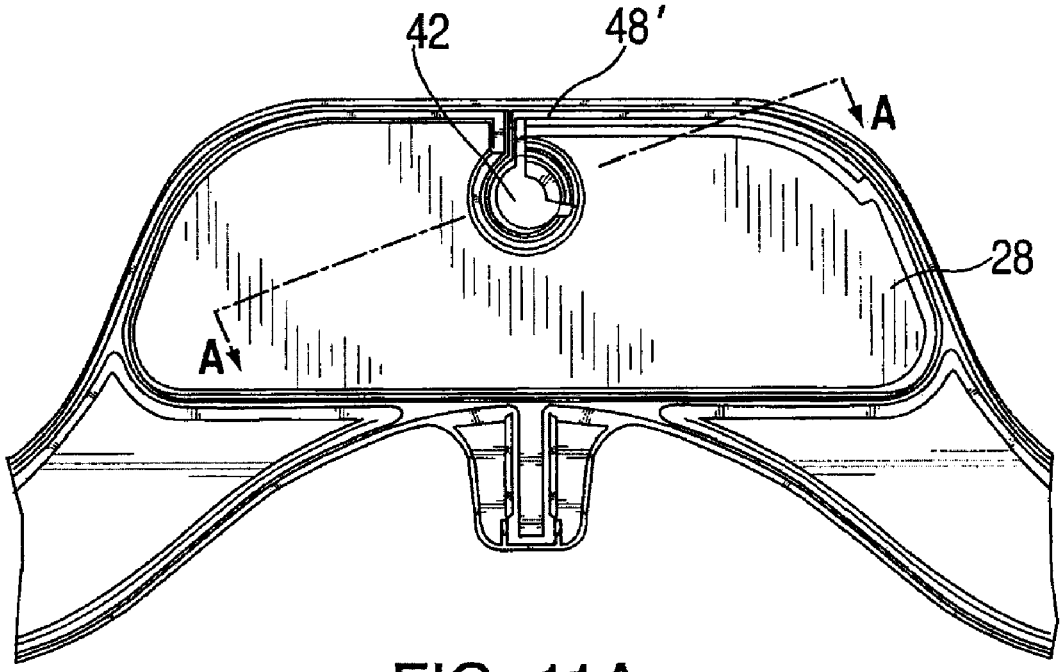
FIG. 11A is a front view of the central portion of the hanger body of FIG. 9.
Figure 11B:
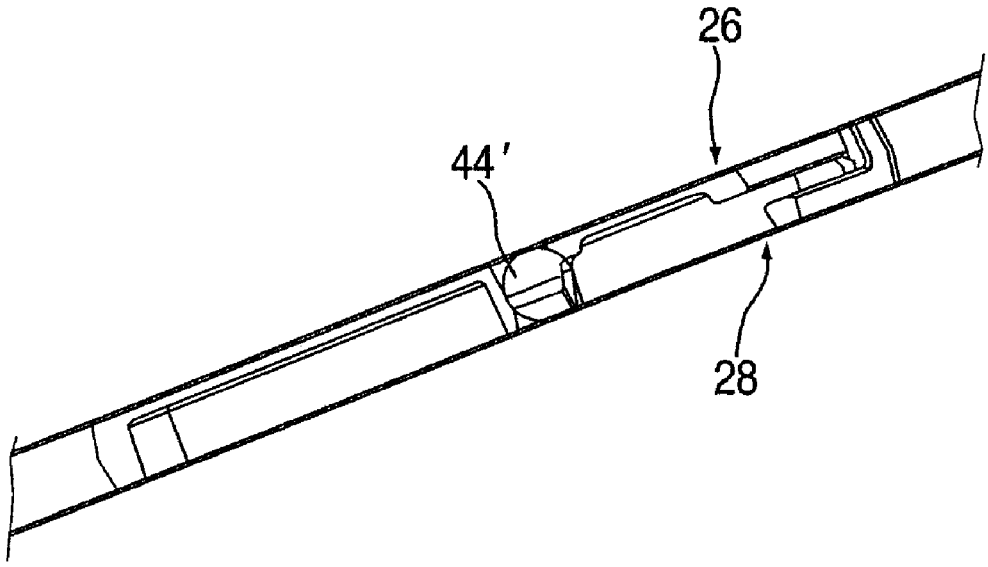
FIG. 11B is a top cross-sectional view of section A-A of FIG. 11A.

Referring now to FIGS. 9 and 10 concurrently, the body 20' is illustrated according to a second embodiment of the present invention. The body 20' and its component are similar to the body 20 described above. Thus, to avoid redundancy, only the design aspects of the body 20' will be discussed. The body 20' does not comprise the protrusion 40. Instead the central portion 30 comprises an opening 42' into the socket 44'. The socket 44' extends through the entire width of the body 20', i.e. from the front surface 28' through the rear surface 26'. The body 20' further comprises a channel 48' that extends along the top surface 22'. The channel 48' has a width that is slightly larger than the width of the straight portion 14 of the hook 10. The hook 10 can be inserted through the channel 48, and then press fit into inner end of the channel 48' in the same manner discussed above with reference to the body 20.

Figure 12A:
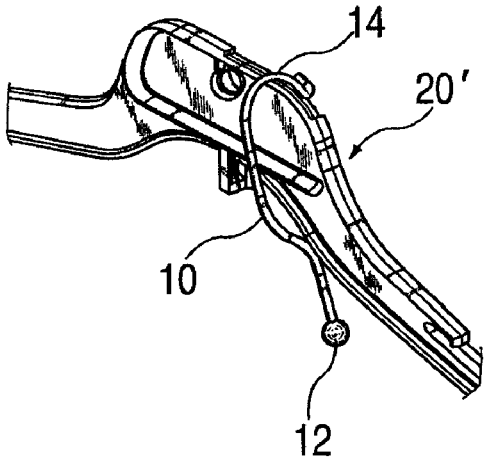
FIG. 12A is a view of the hook of FIG. 7B being inserted into the hanger body of FIG. 9 according to a second embodiment of the present invention.
Figure 12B:
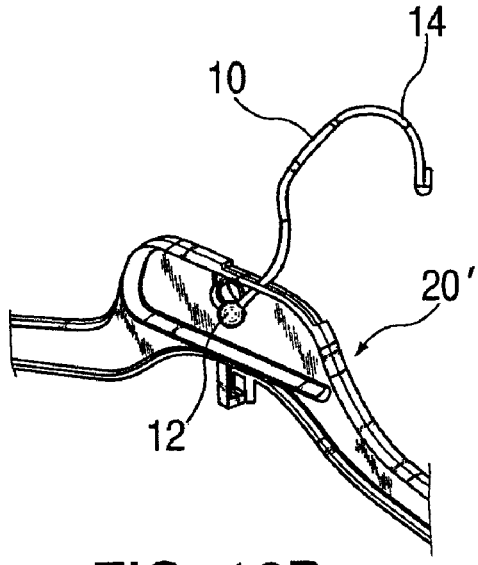
FIG. 12B is a view of the hook and hanger body of FIG. 12A with the hook inserted through the slot of the hanger body, according to a second embodiment of the present invention.
Figure 12C:
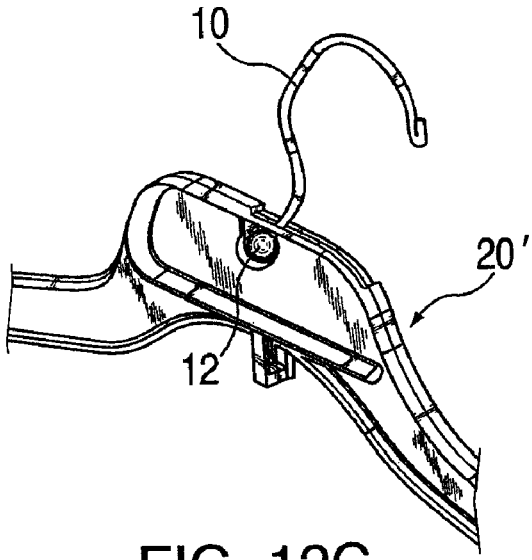
FIG. 12C is a view of the hook and hanger body of FIG. 12A with the ball of the hook inserted into the socket of the hanger body, according to a second embodiment of the present invention.

Referring now to FIGS. 12A, 128 and 12C concurrently, a method of inserting the hook 10 into the body 20' is illustrated. The top portion 14 of the hook 10 is inserted though the channel 48 from the bottom of the channel as shown in FIG. 12A. The hook 10 is then tilted so that the ball 12 can be aligned with the opening 42 and the inserted into the socket 44, as shown in FIG. 12B. The ball 12 is then inserted into the socket 44 and the hook 10 can be further inserted in the channel 48, as shown in FIG. 12C.

Figure 13:
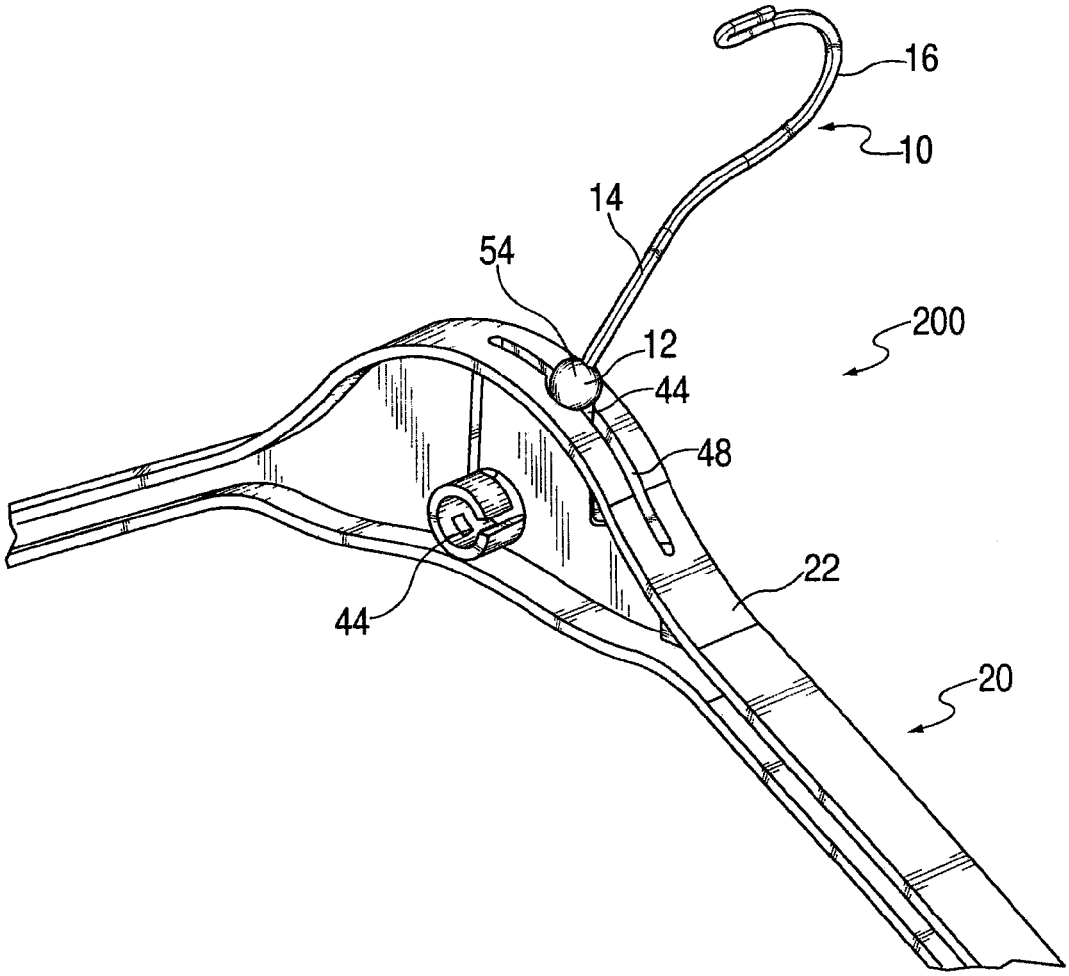
FIG. 13 is a view of the hook of FIG. 7B being inserted into the opening of a hanger body according to a third embodiment of the present invention.
Figure 14:
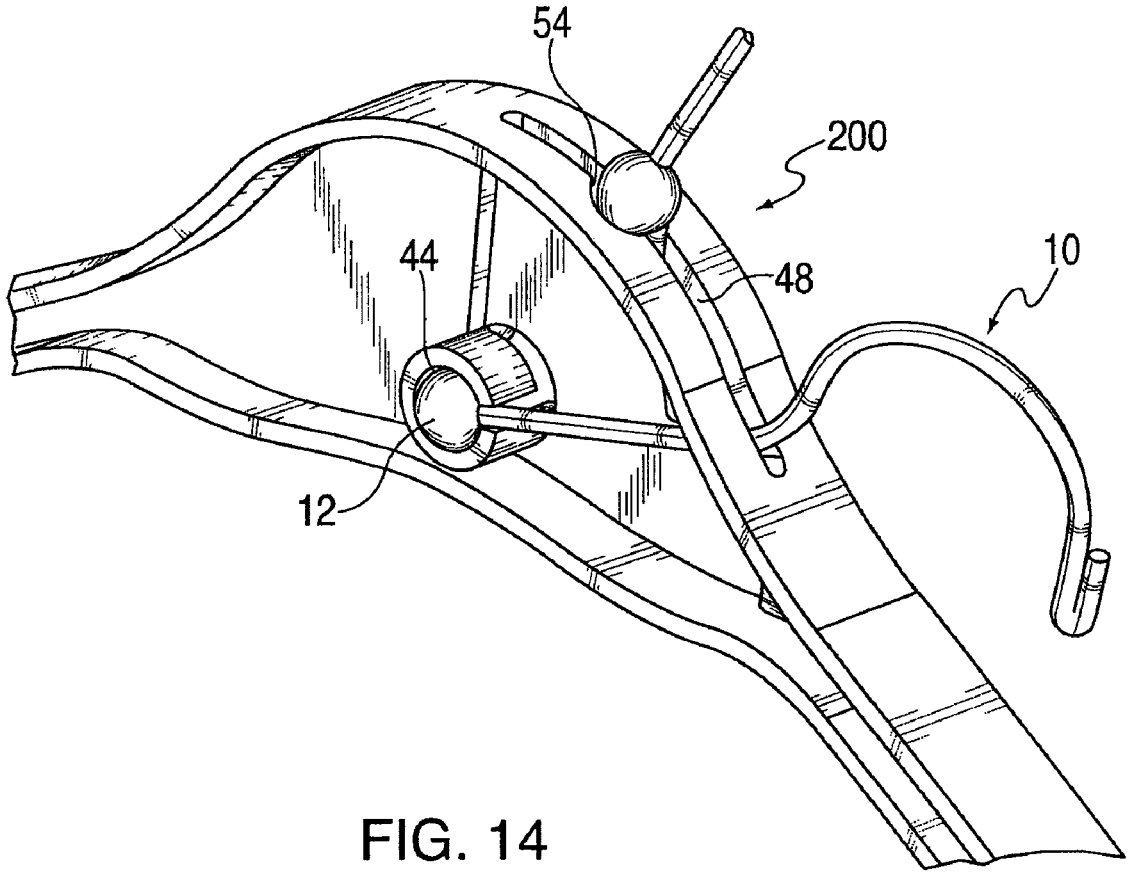
FIG. 14 is a view of the hook and hanger body of FIG. 13 showing the ball of the hook inserted into an opening of the socket, according to a third embodiment of the present invention.
Figure 15:
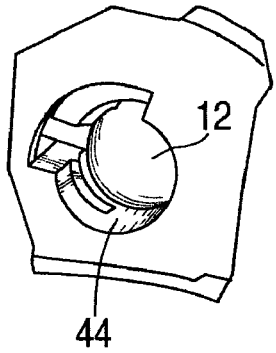
FIG. 15 is a rear view of the ball and opening of FIG. 14, according to a third embodiment of the present invention.

Referring now to FIGS. 13-15, a hanger 200 is illustrated according to a third embodiment of the present invention. The components (and their functioning) of the hanger 200 are substantially similar to those discussed above with reference to the hanger 100. Therefore, to avoid redundancy, only those design aspects of the hanger 200 that substantially differ from the hanger 100 will be discussed. The body 20 of the hanger 200 comprises a channel 48 in the top surface 22. The channel 48 comprises a circular shaped opening 54. The circular shaped opening 54 provides an opening into a passageway (not visible) that leads to the socket 44. The ball 12 of the hook 10 is inserted into the socket 44 via the opening 54. The straight portion 14 of the hook 10 is movable within the channel 48 as discussed above with reference to the hanger 100. The hanger 200 further comprises detents 60 (best visible in FIG. 16) that hold the hook 10 in either the vertical position or the collapsed position.

Figure 16:
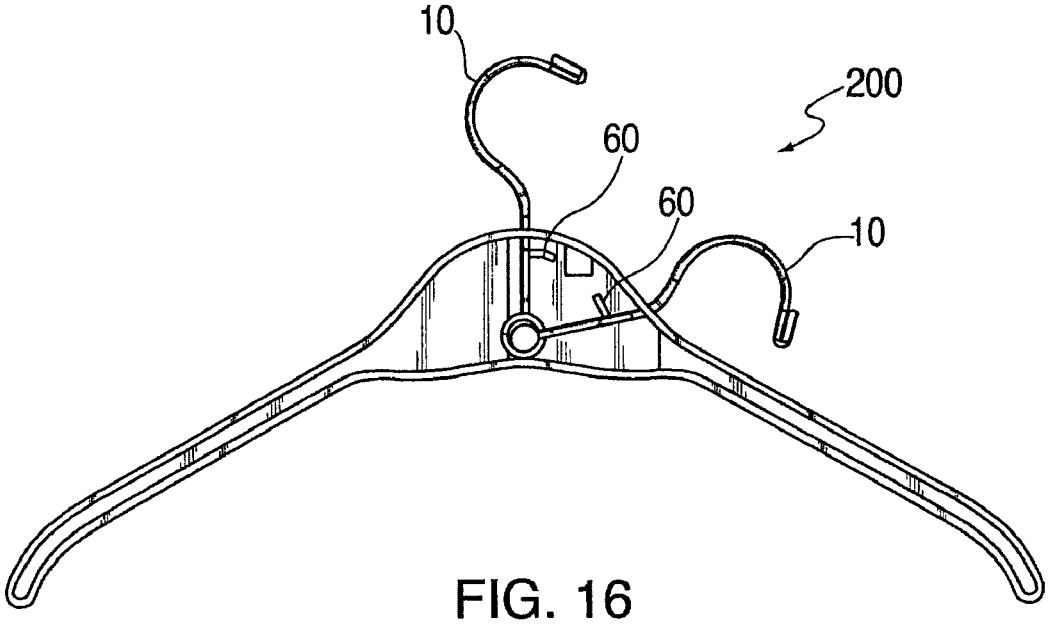
FIG. 16 is a front view of the hanger of FIG. 13 showing the hook in both a vertical position and a collapsed position, according to a third embodiment of the present invention.
Figure 17:
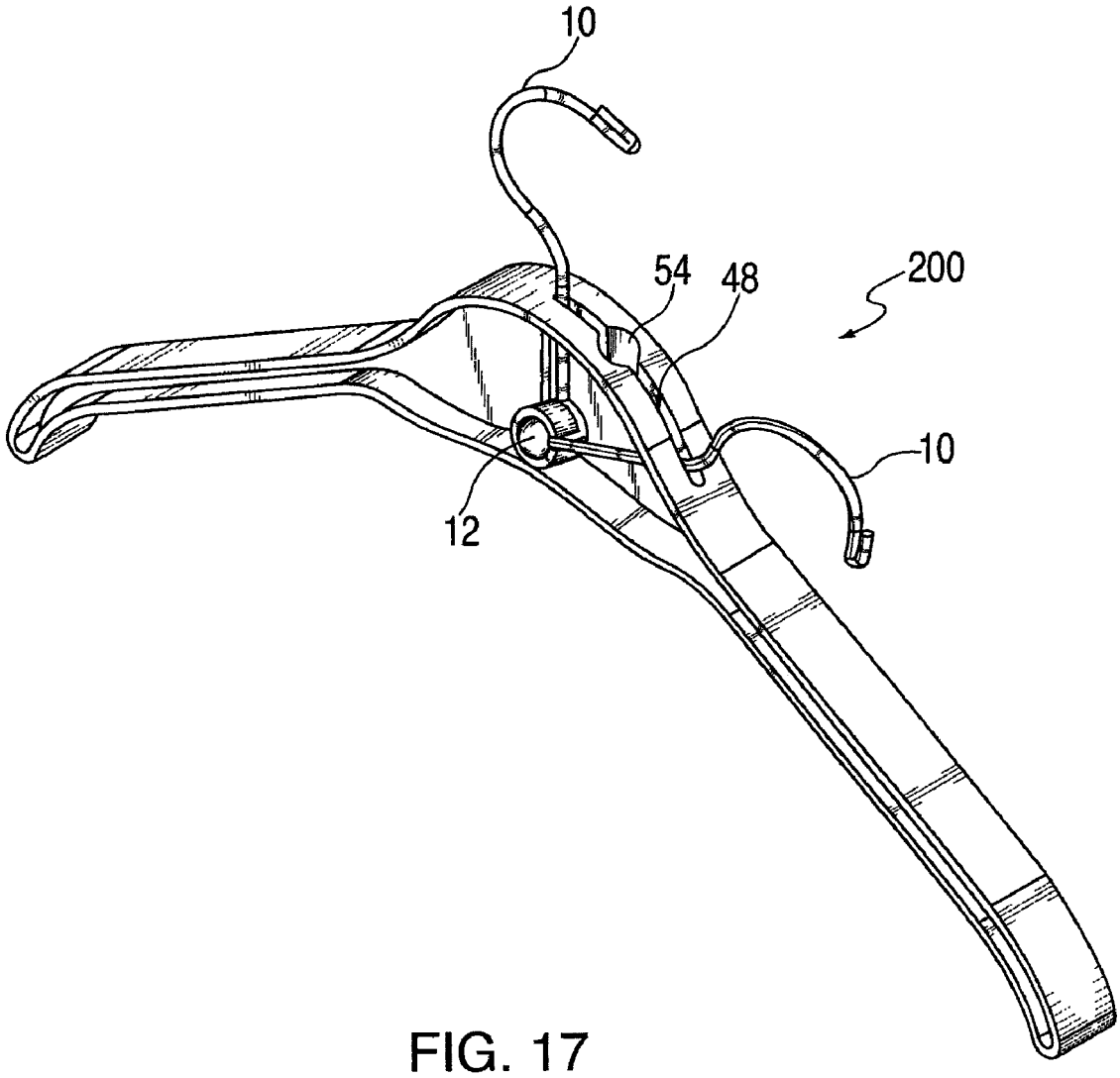
FIG. 17 is a front perspective view of the hanger of FIG. 16, according to a third embodiment of the present invention.

Referring now to FIGS. 16 and 17, the hook 10 is shown in both the vertical position and the collapsed position. Although two hooks 10 are shown, there are not two hooks 10 used with the hanger 200. Rather the hooks 10 are merely illustrating the first, substantially vertical position of the hook 10, and the second, substantially horizontal position of the hook 10. The detents 60 of the hanger 200 are best visible in FIG. 16. There are two detents 60 that are ridge like structures in the body 20. The detents 60 are positioned so that the hook 10 cannot move from the horizontal position to the vertical position (and vice-versa) without the use of force to clear the detents 60.

Figure 18:
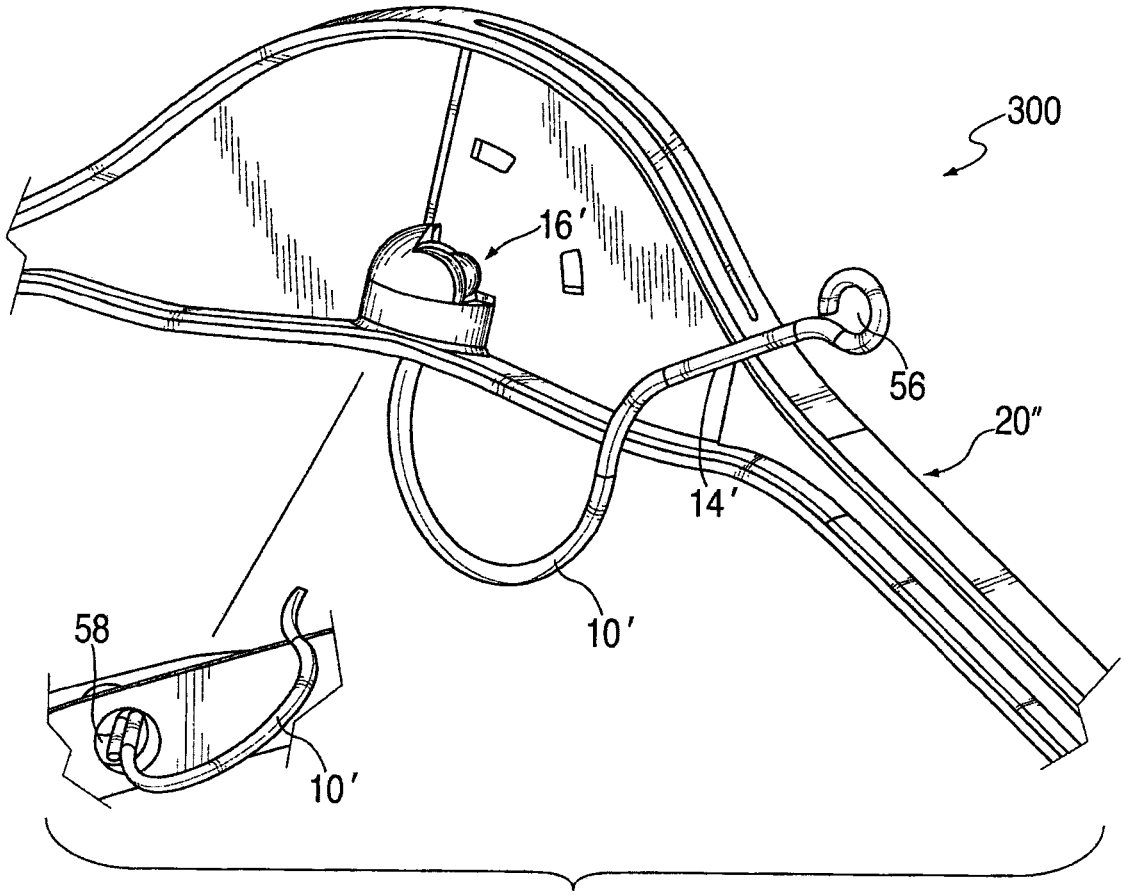
FIG. 18 is a front perspective view of a hanger body and a hook being inserted into an opening in the bottom surface of the hanger body according to the third embodiment of the present invention.

Referring now to FIG. 18 a hanger 300 is shown according to a fourth embodiment of the present invention. The components of the hanger 300 are substantially similar to those discussed above with reference to the hangers 100 and 200. Therefore, to avoid redundancy, only those design aspects of the hanger 300 that differ substantially from the hangers 100 and 200 will be discussed.

The hanger 300 comprises a hook 10'. At the first end 14' of the hook 10 is an opening 56. The opening 56 of the hook 10' allows the hook 10' to rotate along the horizontal axis as discussed above with reference to the hook 10. The body 20" comprises an opening 58 in the bottom surface 28'. The opening 58 allows for the hook 10' to be inserted into the body 20".

Figure 19:
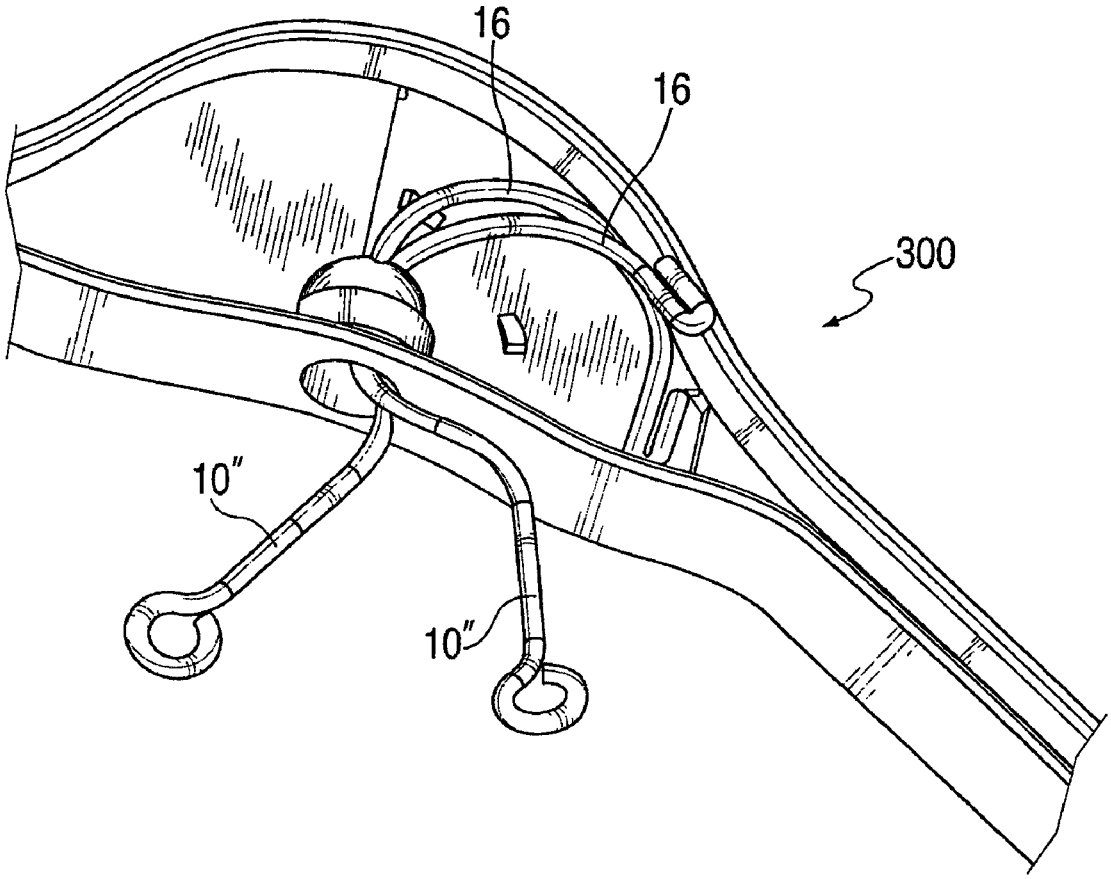
FIG. 19 is a close up view of the hook and hanger body of FIG. 18 showing the hook being rotated, according to the third embodiment of the present invention.
Figure 20:
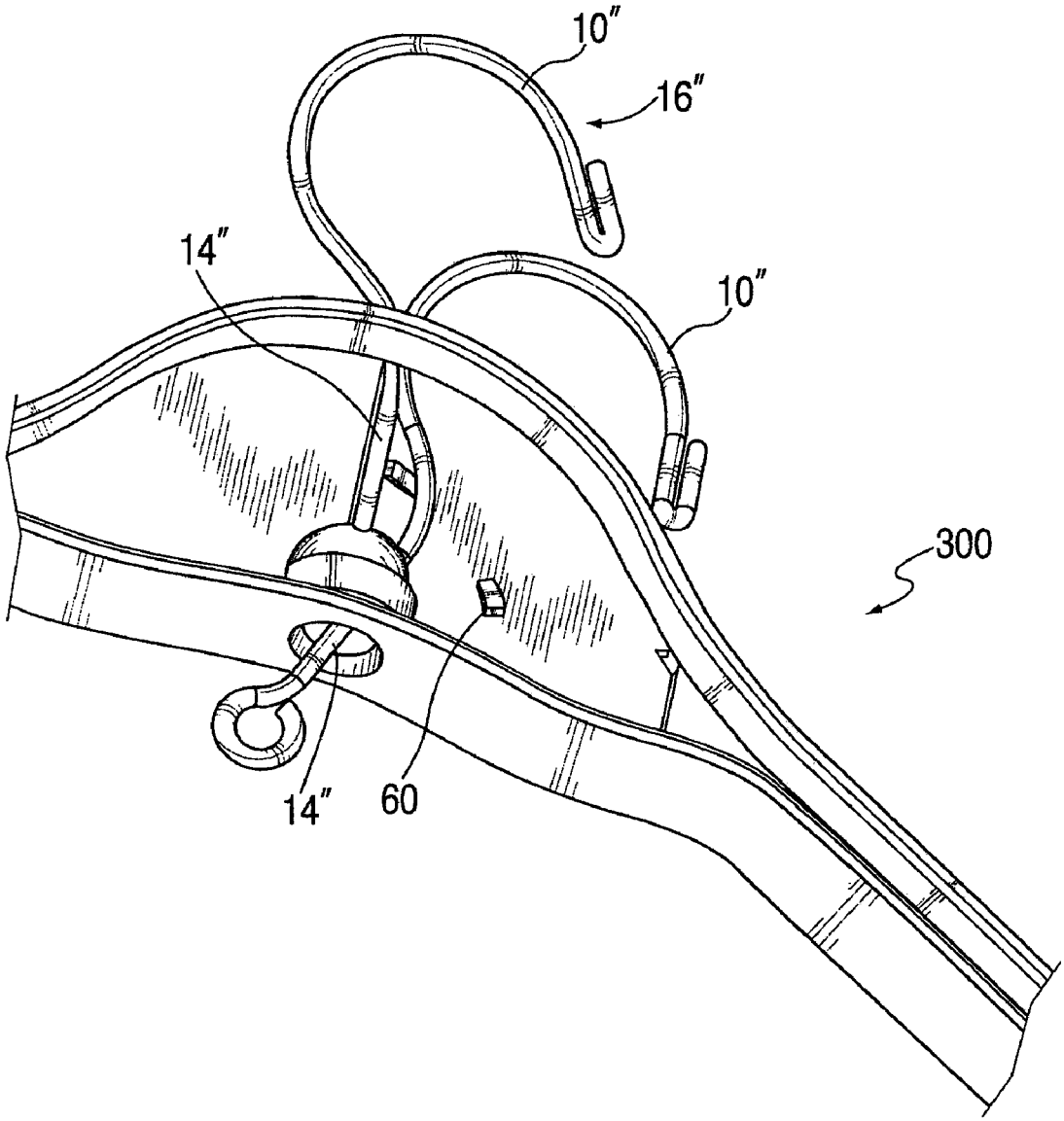
FIG. 20 is a view of the hook and hanger body of FIG. 18 showing the hook being positioned in the vertical position, according to the third embodiment of the present invention.
Figure 21:
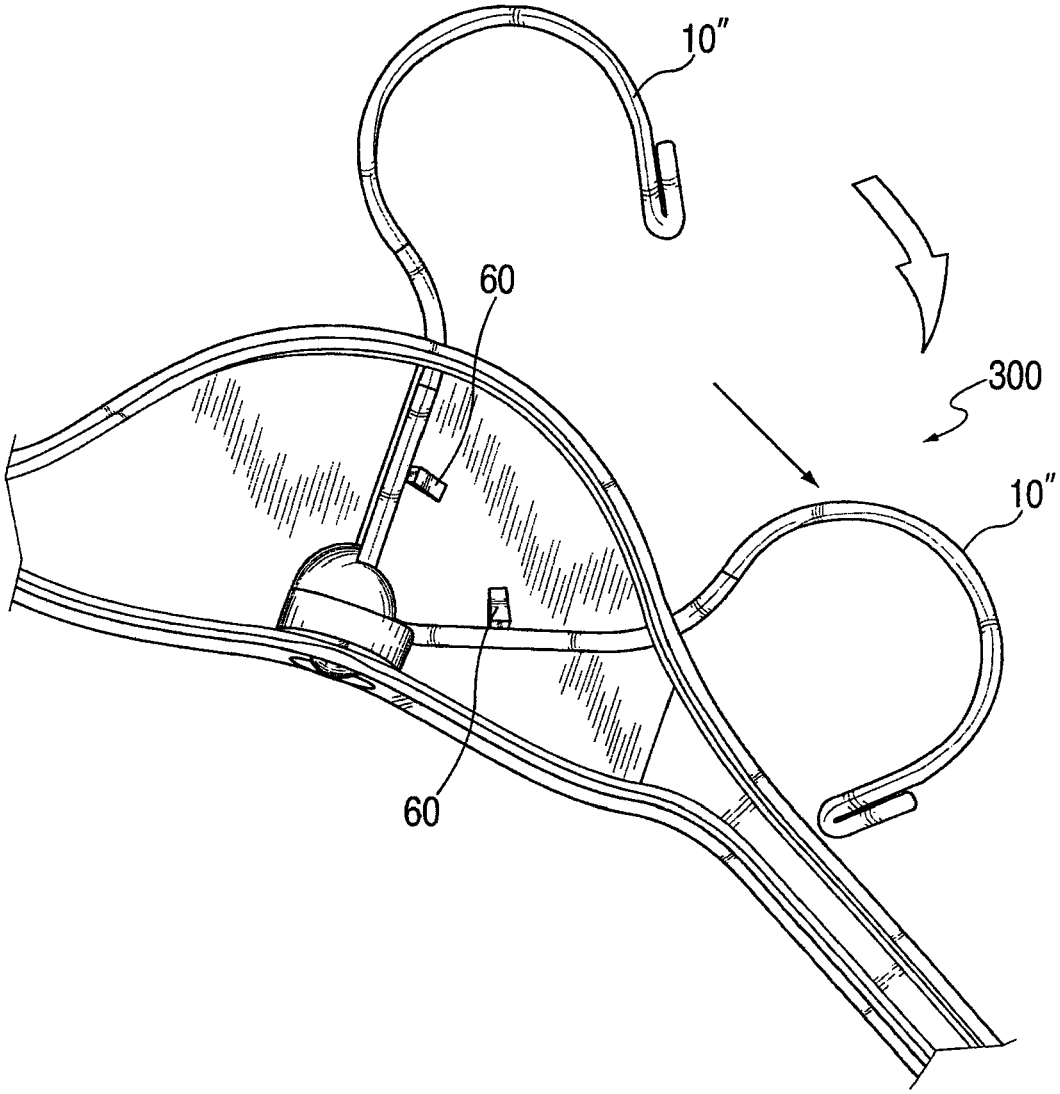
FIG. 21 is a view of the hook and hanger body of FIG. 18 showing the hook being moved from the vertical position to the collapsed position, according to the third embodiment of the present invention.
Figure 22A:
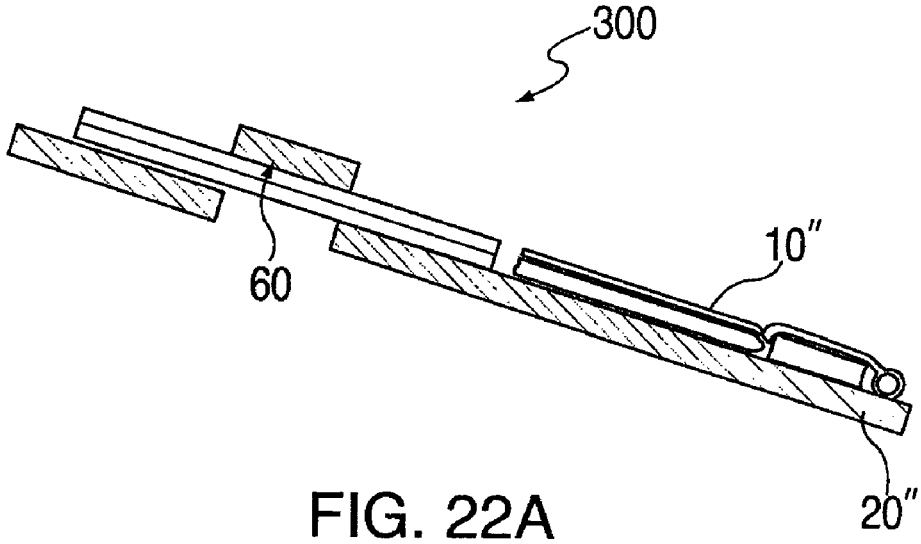
FIG. 22 and FIG. 22A are a front view and a sectional view, respectively, of the hook and hanger body of FIG. 18 according to the third embodiment of the present invention.
Figure 22:
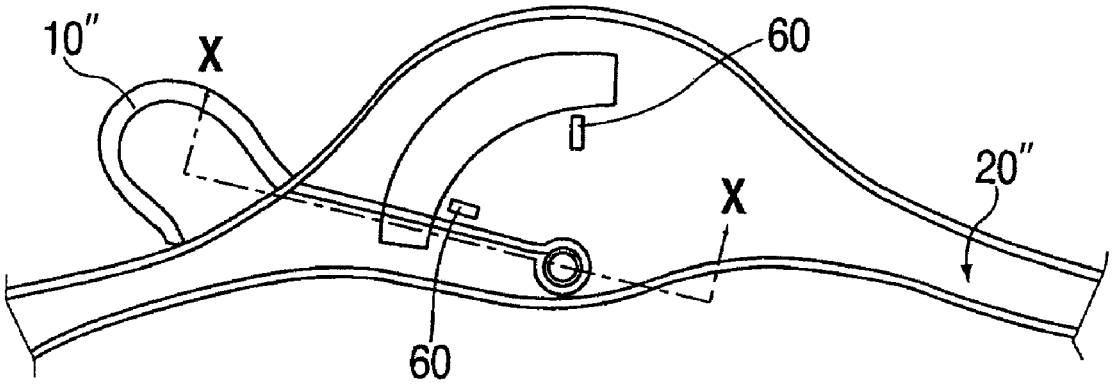

Referring now to FIGS. 19 and 20 concurrently, the insertion of the hook 10' is illustrated. Again, although two hooks 10' are shown, only one hook 10' is used with the hanger 300. The two hooks 10' illustrate different positions of the hook 10' as it is inserted into the body 20". When the hook 10' is inserted into the body 20" it is rotated about the horizontal axis so that the curved portion 16 of the hook 10' can be aligned with the channel (not visible) in the top surface of the body 20". The hook 10' can then be pulled through the channel and the top surface 22 of the body 20" so that the hook 10' can secured in the vertical position (shown in FIG. 20). The hook 10' may then be rotated along the horizontal axis so as to be in the collapsed position (shown in FIG. 21). The hook 10 is secured in either the upright position or the collapsed position by the detents 60.

The present invention may be embodied in other specific forms without departing from the spirit or essential attributes thereof and, accordingly, reference should be made to the appended claims, rather than to the foregoing specifications as indicating the scope of the invention.

What is claimed is:

1. A garment hanger comprising:

a hook having a first end and a second end, the first end disposed adjacent to a straight portion and the second end disposed adjacent to a curved portion;

a body having a top surface and including a protrusion vertically extending from the top surface, the protrusion having an opening for receiving the first end of the hook, a first arm member and a second arm member extending from the body in substantially opposite horizontal directions;

wherein the hook is pivotally connected to the protrusion, the hook adapted to move between a substantially horizontal collapsed position in which the hook is locked and the straight portion of the hook extends in a direction that is substantially parallel with a longitudinal line defined by the body and a substantially vertical upright position in which the hook is locked, the hook being rotatable about an axis; and wherein the hook is alternately attached and detached from the protrusion via the opening, and wherein the straight portion of the hook is vertically disposed above the top surface of the body when disposed in the substantially horizontal collapsed position.

2. The hanger of claim 1, wherein the first end of the hook comprises a ball and wherein the ball of the hook is inserted into a socket defined by the protrusion via the opening.

3. The hanger of claim 1 wherein the protrusion comprises a channel through which the hook moves between the substantially horizontal collapsed position and the substantially vertical upright position and at least one detent for holding the hook in the upright or collapsed position.

4. The hanger of claim 1, wherein the protrusion comprises an indentation for receiving a portion of the hook when the hook is in the upright position.

5. The garment hanger of claim 1, wherein the curved portion of the hook is vertically disposed above one of the first and second arms when the hook is in the first substantially horizontal position.

6. The garment hanger of claim 1, wherein the hook portion and a section of the straight portion of the hook are disposed externally of the body when the hook is disposed in the substantially horizontal collapsed position.

7. The garment hanger of claim 1, wherein the hook is pivotally coupled to the protrusion at a position that is disposed above an upper surface of the body.

8. A garment hanger comprising:

a central support member;

a protrusion vertically extending from a top surface of the central support member, the protrusion defining a socket and a channel, the channel opening in a direction that faces a first arm member and including a detent;

a support hook having first and second ends, the first end of the support hook disposed adjacent to a straight portion and the second end of the support hook disposed adjacent to a curved portion of the support hook, the first end of the support hook pivotally connected within the socket and channel defined by the protrusion, the support hook adapted to pivot about the socket within the channel between a collapsed position in which the support hook is locked and a generally upright position in which the support hook is locked, wherein the straight portion of the support hook extends in a direction that is substantially parallel with a longitudinal direction line by the first arm member and is disposed above an upper surface of the central support member when the hook is disposed in the collapsed position; and a second arm member, each of the first and second arm members connected to and extending away from the central support member, wherein the straight portion of the hook is vertically disposed above one of the first arm in the collapsed position.

9. The hanger of claim 8, wherein the detent holds the hook in the substantially upright position.

10. The garment hanger of claim 8, wherein the curved portion of the support hook is vertically disposed above the first arm when the hook is in the collapsed position.

11. The garment hanger of claim 8, wherein the socket and the channel are disposed above an upper surface of the central support member.

12. A garment hanger, comprising:

a body including a central support member, first and second arms extending in substantially opposite directions away from the central support member, and a protrusion extending from a surface of the central support member in a direction that is substantially orthogonal to a longitudinal line defined by the body of the garment hanger, the protrusion defining a socket and a channel, a portion of the channel opening in a direction that faces the first arm; and a hook having a first end disposed adjacent to a straight portion of the hook and a second end disposed adjacent to a curved portion of the hook, the first end of the hook pivotally coupled within the socket of the protrusion, a first portion of the straight portion of the hook adjacent to the first end received within the channel defined by the protrusion, wherein the hook is configured to pivot within the channel from a collapsed position in which the straight portion of the hook extends in a substantially parallel direction to the longitudinal line defined by the body and in which the hook is prevented from further pivoting by a first surface of the channel to an upright position in which the straight portion of the hook extends in a direction that is substantially parallel with the direction in which the protrusion extends from the surface of the central support member and in which the hook is prevented from further pivoting by a second surface of the channel, wherein a remaining portion of the straight portion of the hook is disposed externally to the body in both the collapsed and upright positions.

* * * * *